United States Patent [19]

Mummey et al.

[11] Patent Number: 4,542,951

[45] Date of Patent: Sep. 24, 1985

[54] OPERATING MECHANISM FOR A PLUGBOARD SYSTEM

[75] Inventors: Dale B. Mummey, Camp Hill; Carl D. Oberman, New Cumberland, both of Pa.

[73] Assignee: AMP Incorporated, Harrisburg, Pa.

[21] Appl. No.: 599,902

[22] Filed: Apr. 13, 1984

[51] Int. Cl.[4] ..... H01R 13/629

[52] U.S. Cl. ..... 339/75 M; 339/75 MP

[58] Field of Search ..... 339/75 R, 75 M, 75 MP

[56] References Cited

U.S. PATENT DOCUMENTS

| | | | |
|---|---|---|---|
| 2,927,295 | 3/1960 | Sitz | 339/75 M |
| 3,129,044 | 4/1964 | Lyman, Jr. et al. | 339/75 M |
| 3,425,025 | 1/1969 | Williams | 339/75 M |
| 3,430,183 | 2/1969 | Feeser et al. | 339/75 R |
| 3,629,788 | 12/1971 | Hartley | 339/75 M |
| 4,134,631 | 1/1979 | Conrad et al. | 339/75 M |
| 4,332,432 | 6/1982 | Colleran | 339/75 M |
| 4,344,663 | 8/1982 | Ognier et al. | 339/75 M |
| 4,456,318 | 6/1984 | Shibata et al. | 339/75 MP |

*Primary Examiner*—John McQuade

*Attorney, Agent, or Firm*—Adrian J. LaRue; Anton P. Ness

[57] ABSTRACT

An operating mechanism for a plugboard system to connect and disconnect electrical terminals of a front bay with respective electrical terminals of a rear bay comprises hanger plates and sliding cam plates mounted on a rear frame, the cam plates having profiled cam slots and L-shaped slots therein. An operating member is pivotally mounted into the rear frame and includes rollers which are disposed in the L-shaped slots so that when the operating member is moved from one position to another position, the rollers move along the L-shaped slots causing the cam plates to move along the rear frame which causes the cam slots to linearly move support members on a front frame thereby connecting or disconnecting the electrical terminals.

12 Claims, 6 Drawing Figures

40
18
48
44
11
50
74
72
76
42
48
46
50
78
56
80
52
82
54
62
58
56
60
70
68
66
78
56
80
54
62
64
82
60
56

OPERATING MECHANISM FOR A PLUGBOARD SYSTEM

FIELD OF THE INVENTION

This invention relates to an operating mechanism and more particularly to an operating mechanism for a plugboard system.

BACKGROUND OF THE INVENTION

Plugboard systems are generally used in conjunction with computers. The rear bay is stationary and contains electrical terminals such as coaxial connectors, signal contacts and power contacts that are arranged in rows and are connected to electronic circuits. These circuits can be interconnected by coaxial connector and contact patchcords selectively arranged in holes in a front bay. When the front bay is moved relative to the rear bay from an inoperative position to an operative position, the coaxial connectors, signal contacts and power contacts in the front bay are electrically connected with respective coaxial connectors, signal contacts and power contacts in the rear bay. The electrical terminals are the type that axially mate with each other; thus the front bay must move straight toward and away from the rear bay during the connecting and disconnecting of the coaxial connectors, signal and power contacts.

A large number of connectors are involved in these plugboard systems which results in substantial resistance when the connectors are connected and disconnected. An operating mechanism is therefore required that can effectively connect and disconnect the connectors and precisely guide the connectors into electrical engagement without damaging the connectors over repeated operations thereby assuring optimum electrical continuity between the interconnected bays.

SUMMARY OF THE INVENTION

According to the present invention, an operating mechanism for a plugboard system or the like to connect and disconnect electrical terminals of a front bay with respective electrical terminals of a rear bay comprises a rear frame in which a rear panel is mounted, the rear panel containing rows of electrical terminals. Hanger plates are located on opposite side members of the rear frame in alignment with each other and they include straight guide slots, the hanger plates serving to receive respective support members extending outwardly from side members of a front frame of the front bay. Sliding cam plates are mounted on the rear frame, are movable along the hanger plates, and have spaced profiled cam slots therein. The cam slots have entrance sections extending parallel to the straight guide slots, angled sections and straight sections disposed normal to the entrance sections. An operating member is mounted onto the rear frame and includes a shaft extending through L-shaped openings in the sliding cam plates. Arms having bearing members mounted thereon are secured to the shaft with the bearing members being disposed in respective L-shaped openings of the cam plates so that when the operating member is moved from one position to another position with the support members positioned in the guide slots of the hanger plates at the inner ends of the entrance sections of the cam slots, the sliding cam plates move in unison along the side members of the rear frame causing the angled sections and the straight sections of the cam slots to move the support members along the straight guide slots thereby electrically connecting the respective electrical terminals of the front and rear bays together.

DETAILED DESCRIPTION OF THE INVENTION

Figure 1:
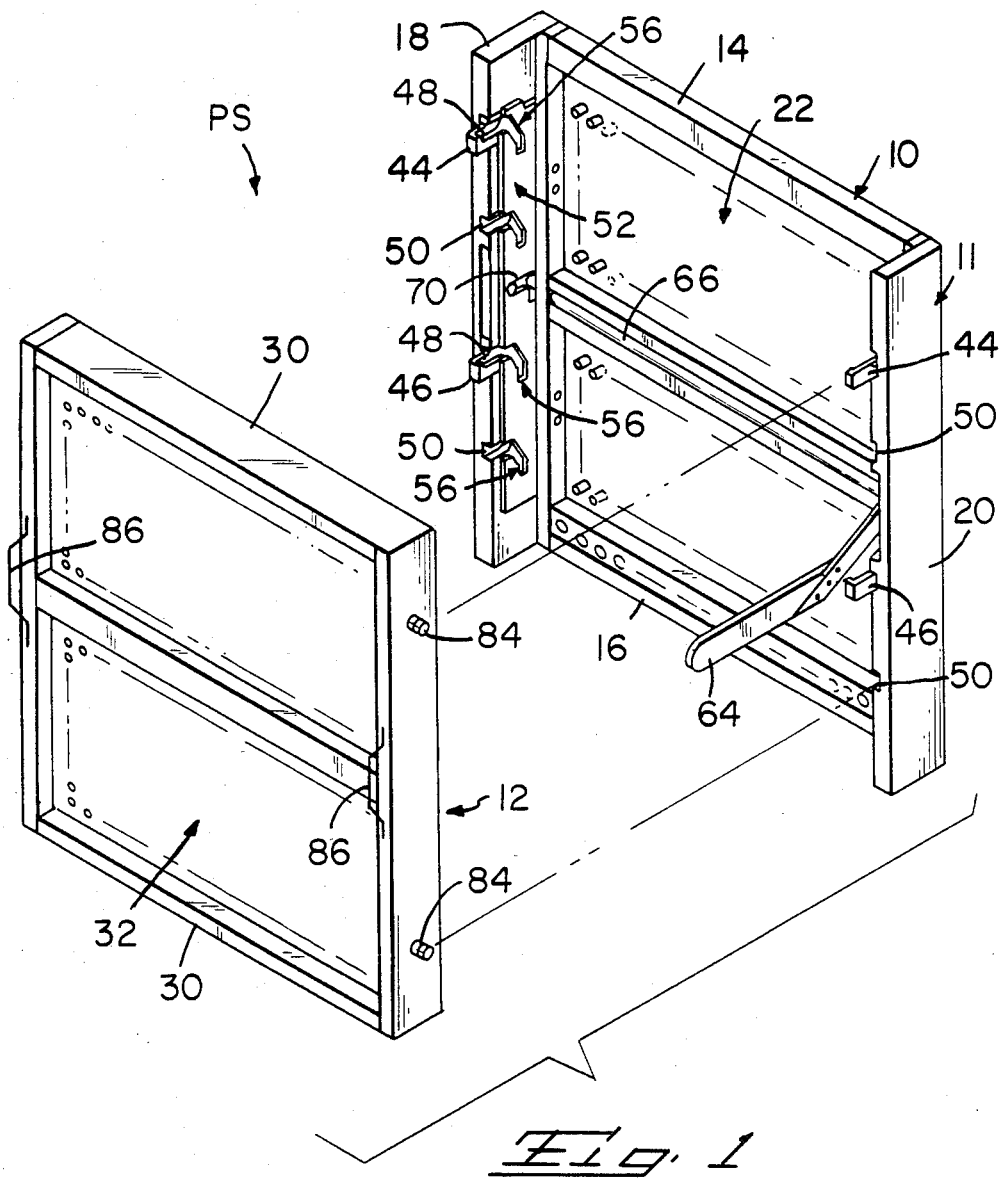
FIG. 1 is a perspective view of a plugboard system with the front bay exploded from the rear bay.
Figure 5:
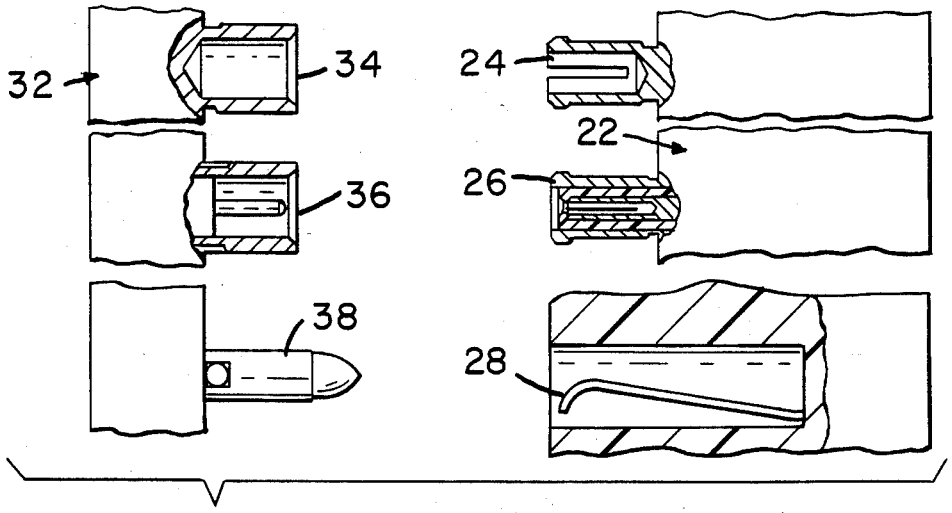
FIG. 5 illustrate parts of the panels of the front and rear bays with the electrical connectors therein, some of which are in part longitudinal section.

A plugboard system PS is shown in FIG. 1 which includes a rear bay 10 and a front bay 12. Rear bay 10 includes a rear frame 11 that contains a top member 14, bottom member 16 and side members 18 and 20. A dielectric panel 22 comprising an array of dielectric blocks is secured in the rear bay frame and has rows of holes therethrough in which electrical terminals 24, 26, and 28 are secured as shown in FIG. 5. Electrical terminals 24 are used for conducting power, electrical terminals 26 of the coaxial type are used for conducting high frequency signals, and electrical terminals 28 are of the leaf spring type for conducting lower frequency signals.

Front bay 12 includes a front frame 30 in which is secured a dielectric panel 32 having rows of holes therethrough in which are secured complementary electrical terminals 34, 36 and 38, as shown in FIG. 5, which electrically mate with respective electrical terminals 24, 26 and 28 when front bay 12 is moved in a straight direction toward rear bay 10 and to disconnect the terminals when front bay 12 is moved away from rear bay 14 via an operating mechanism which will be described in greater detail hereinafter.

Figure 2:
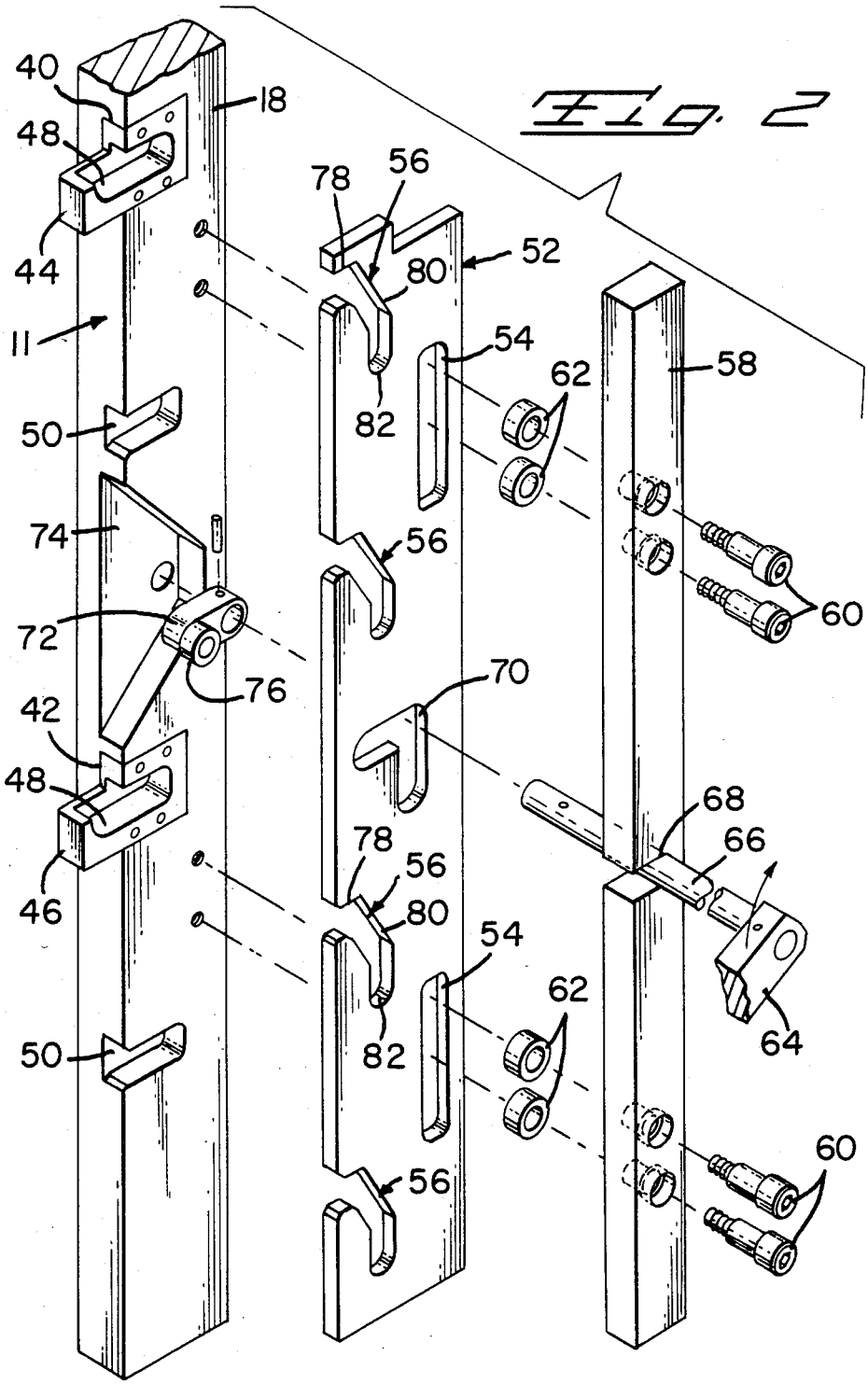
FIG. 2 is an exploded and perspective view of the parts of one section of the operating mechanism.
Figure 3:
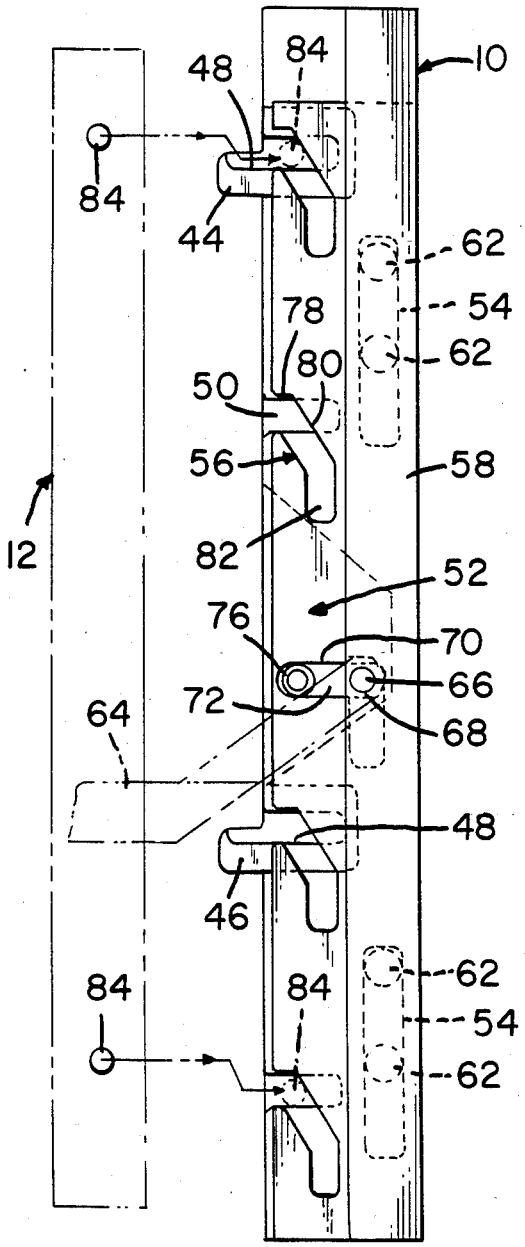
FIGS. 3 and 4 are part side elevational views of the plugboard system illustrating the operation of the operating mechanism.
Figure 4:
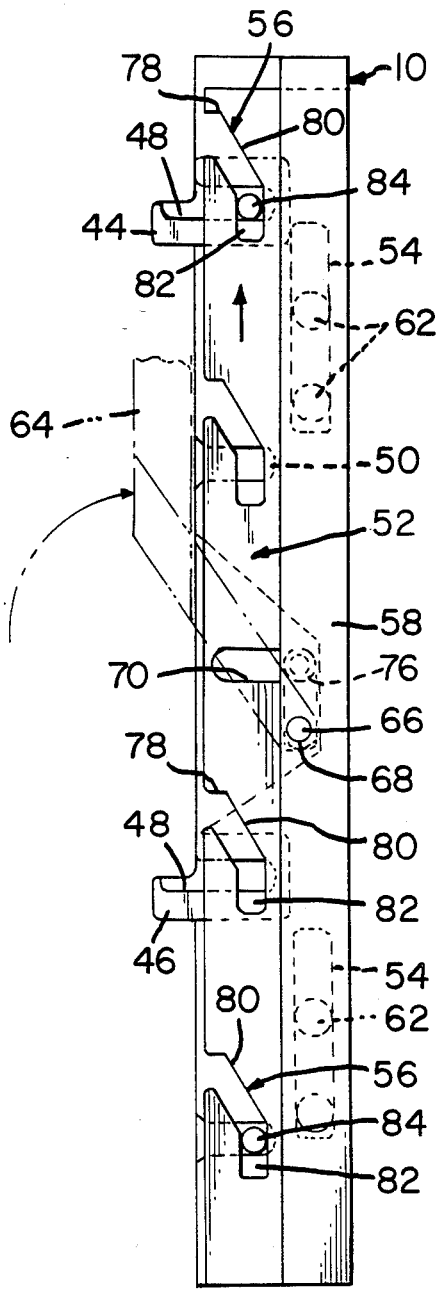

FIG. 2 shows the details of the operating mechanism and FIGS. 3 and 4 illustrate the operation thereof. Side members 18 and 20 of rear frame 11 have upper recesses 40 and lower recesses 42. Upper hanger plates 44 are secured in upper recesses 40 while lower hanger plates 46 are secured in lower recesses 42. Hanger plates 44 and 46 are provided with straight guide slots 48 that extend inwardly along side members 18 and 20 toward the rear ends thereof. Straight guide slots 50 are also located in side members 18 and 20 which are parallel with respect to guide slots 48. Hanger plates 44 and 46 extend outwardly from the front surfaces of side members 18 and 20 and so do guide slots 48 therein. Hanger plates 44 and 46 are also flush with the inside surfaces of side members 18 and 20.

Sliding cam plates 52 have oblong holes 54 therein disposed between pairs of cam slots 56. Mounting plates 58 are secured onto the inside surfaces of side members 18 and 20 via shoulder screws 60 which extend through sleeve or roller bearing members 62 disposed in oblong holes 54. Sleeve or roller bearing members 62 enable sliding cam plates 52 to slidably move backward and forward along side members 18 and 20 in a very smooth manner with minimal friction so that cam slots 56, which are respectively associated with guide slots 48 and 50, are moved relative thereto.

Lever 64 is secured to a shaft 66 that extends through slots 68 in mounting plates 58 and through L-shaped openings 70 in cam plates 52. An arm 72 is secured onto shaft 66 at each end thereof and is disposed in a trapezoidal recess 74 within members 18 and 20 so as to be movable therein. Trapezoidal recess 74 in side member 20 is deeper so as to enable lever 64 to move therein along with arm 72. Roller bearing members 76 are secured to the respective ends of arms 72 and they are respectively disposed in L-shaped openings 70 of cam plates 52 so that when lever 64 is moved from one position to another, bearing members 76 move along L-shaped openings 70 thereby causing cam plates 52 to reciprocally move along bearing members 62 within holes 54 which cause cam slots 56 to move relative to straight slots 48 and 50. Roller bearing members 76 move smoothly and with reduced friction within L-shaped openings 70. Shaft 66 is mounted in the inner sections of L-shaped openings 70 so that when cam plates 52 move under the action of bearing members 76 moving along the outer sections of L-shaped openings 70, cam plates 52 can move relative to shaft 66.

Cam slots 56 in sliding cam plates 52 have entrance sections 78, angled sections 80 and straight sections 82 which are disposed normal to entrance sections 78. Entrance sections 78 are disposed parallel with respect to respective guide slots 48 and 50.

Support members 84 are mounted on the sides of front frame 30 of front bay 12 and they are in the form of pairs of sleeve or roller bearing members. Handles 86 are secured onto the frame of front bay 12 to enable a person to position support members 84 into respective slots 48 of hanger members 44 and 46. Front bay 12 is then pushed inwardly so that support members 84 move into entrance sections 78 of cam slots 56 until they engage angled sections 80 as shown in FIG. 3, then lever 64 is moved in an inner direction causing shaft 66 to rotate and in so doing arms 72 are moved within trapezoidal recess 74 and bearing members 76 move along L-shaped openings 70 thereby moving sliding cam plates 52 relative to side members 18 and 20 which causes angled sections 80 and straight sections 82 of cam slots 56 to move along support members 84 which moves front bay 12 in a straight direction relative to rear bay 10 so that electrical terminals 24, 34, 26, 36, 28 and 38 are moved into electrical engagement with one another. When lever 64 is moved outwardly, a reverse operation to that described above takes place thereby causing front bay 12 to move outwardly from rear bay 10 thereby disconnecting electrical terminals 24, 34, 26, 36, 28 and 38 from one another. Thus, front bay 12 can be moved towards and away from rear bay 10 in a straight direction to enable the electrical terminals to electrically connect and disconnect with one another in a precision guided manner that takes place via an operating mechanism that operates smoothly with substantially reduced friction.

Figure 6:
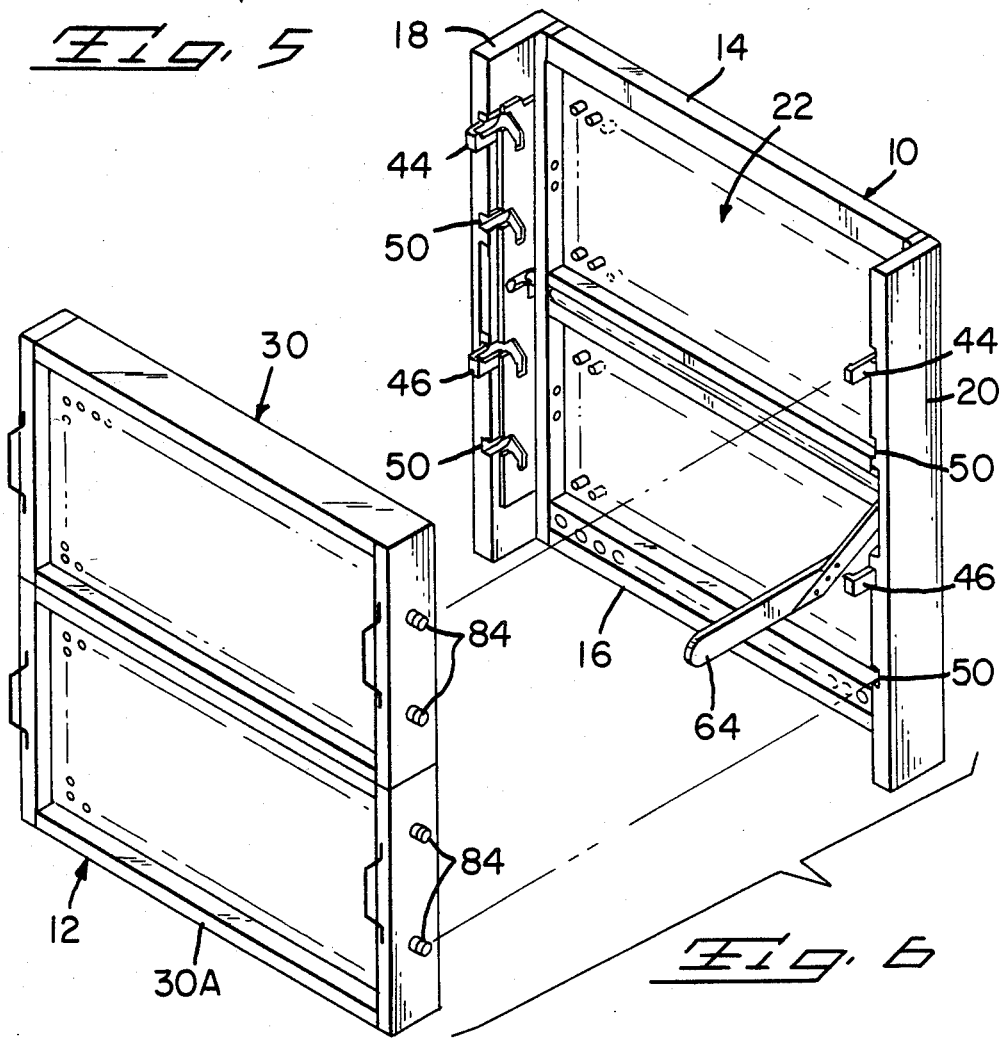
FIG. 6 is a view similar to FIG. 1 showing an alternative embodiment.

As shown in FIG. 6, front bay 12 can be divided into two frame members 30 and 30A each of which has support members 84 mounted on side members of the frame members so that support members 84 of upper frame member 30 can be mounted on upper hanger plates 44 with support members 84 being disposed in straight guide slots 48 and 50 while support members 84 of lower frame member 30A are disposed in guide slots 48 of lower hanger plates 46 and guide slots 50 in side members 18 and 20 of the rear frame of rear bay 10. Front bay 12 of FIG. 6 is operated in the same manner relative to rear bay 10 as described above with respect to FIG. 1.

Sliding cam plates 52 force the electrical terminals of the front bay firmly and evenly into electrical engagement with the respective electrical terminals in the rear bay with a positive linear movement because the outer sleeve or roller bearing members of support members 84 move along straight guide slots 48 in the hanger plates 44, 46 and in straight guide slots 50 in side members 18, 20 of rear frame 11 while the inner sleeve or roller bearing members of support members 84 move within angled sections 80 and straight sections 82 of cam slots 56 when cam plates 52 are moved relative to side members 18, 20.

Straight sections 82 of cam slots 56 can be angled back toward the front of cam plates 52 if desired to subject the electrical terminals to a reverse wiping action.

The operating mechanism of the present invention assures positive control of the front bay at all times so that the electrical terminals are electrically connected and disconnected with respective electrical terminals of the rear bay without damage thereto. Also, a large number of electrical terminals of a front bay and a rear bay are connected and disconnected by use of the present operating mechanism even though substantial resistance is encounted during connecting and disconnecting the terminals. Moreover, the operating mechanism is of simplified construction and operates in a smooth manner with substantially reduced friction.

We claim:

1. An operating mechanism for a plugboard system or the like to connect and disconnect electrical terminals of a front bay with respective electrical terminals of a rear bay, comprising:

a rear bay comprising a rear frame in which a rear panel having rows of electrical terminals is mounted;

hanger plates mounted onto opposite side members of the rear frame in alignment with each other and including guide slots therein, the hanger plates serving to receive in the guide slots thereof support members extending outwardly from side members of a front frame of the front bay;

sliding cam plates mounted on the rear frame and being movable along the hanger plates and having spaced profiled cam slots therein, the cam slots having entrance sections, angled sections and straight sections, the entrance sections extending parallel to the guide slots, the straight sections being disposed generally normal to the entrance sections and the angled sections extending between the entrance sections and the straight sections; and an operating member mounted onto the rear frame to move said cam plates in unison relative to said hanger plates between an inoperative position and an operative position, said operating member including a shaft extending through L-shaped openings in the cam plates, arms secured to said shaft and having bearing means thereon which are disposed in respective L-shaped openings, said bearing means being movable in said L-shaped openings when said shaft is moved by operation of said operating member to move the cam plates between said inoperative and said operative positions, so that with the support members positioned in the respective guide slots of the hanger plates and moved into said entrance sections of the cam slots, the sliding cam plates move along the side members of the rear frame causing the angled sections and the straight sections of the cam slots to move the support members along the guide slots in a straight inward direction thereby electrically connecting the respective electrical terminals of the front and rear bays together.

2. An operating mechanism as set forth in claim 1, wherein said sliding cam plates have oblong holes in which are disposed roller bearing members on which the sliding cam plates are moved.

3. An operating mechanism as set forth in claim 1, wherein the side members of the rear frame have aligned guide slots located below the hanger plates and respective cam slots are associated therewith so that support members of two front frames can be simultaneously moved toward the rear bay.

4. An operating mechanism as set forth in claim 1, wherein trapezoidal recesses are located in said side members of the rear frame in which said arms are respectively disposed and movable therein.

5. An operating mechanism as set forth in claim 1, wherein said L-shaped openings are centrally located in said sliding cam plates.

6. An operating mechanism as set forth in claim 1, wherein said bearing means are roller bearing means.

7. An operating mechanism for positioning a first panel member in operative relationship with a second panel member so that associated mating electrical terminals in the first and second panel members can be electrically connected or disconnected when the panel members are moved relative to each other, comprising:

a rear frame in which the second panel member is mounted and having side members;

hanger plates mounted on the side members opposite and in alignment with each other and having straight guide slots therealong;

sliding cam plates mounted on respective side members extending adjacent to said hanger plates and having spaced profiled cam slots including entrance sections, angled sections and straight sections, said entrance sections in one position of the cam plates register with respective guide slots of said hanger plates, said straight sections being substantially normal relative to said entrance sections and said angled sections extending between said entrance sections and said straight sections;

a front frame in which the first panel member is mounted, supporting members on side sections of the front frame, said supporting members adapted to be positioned in respective guide slots of said hanger plates; and operating means on said rear frame to move said cam plates in unison relative to said hanger plates between an inoperative position and an operative position, said operating means including a shaft extending through L-shaped openings in said cam plates, arm means secured to said shaft and having bearing means on said arm means which are disposed in respective L-shaped openings, said bearing means being movable in said L-shaped openings when said shaft is moved to move the cam plates between the inoperative position and the operative position, so that with said cam plates in their inoperative position and when the supporting members of the front frame are in their respective guide slots of said hanger plates and moved into said entrance sections of said cam slots, movement of said cam plates under the action of said operating means to said operative position causes said angled sections and straight sections of said cam slots to move said supporting members along said guide slots in a straight inward direction thereby electrically connecting the electrical terminals of the first panel member with respective electrical terminals of the second panel member.

8. An operating mechanism as set forth in claim 7, wherein said L-shaped openings are centrally located in said cam plates between said cam slots.

9. An operating mechanism as set forth in claim 7, wherein said bearing means comprise roller bearing means.

10. An operating mechanism as set forth in claim 8, wherein oblong holes are located in said cam plates on each side of said L-shaped openings and roller bearing members are disposed in said oblong holes.

11. An operating mechanism as set forth in claim 7, wherein the side members of the rear frame have aligned guide slots located below the hanger plates and respective cam slots are associated therewith.

12. An operating mechanism as set forth in claim 7, wherein trapezoidal recesses are located in said side members of the rear frame in which said arms are disposed and movable therein.

* * * * *